US007278173B2

(12) United States Patent
Turner

(10) Patent No.: US 7,278,173 B2
(45) Date of Patent: Oct. 9, 2007

(54) ADJUSTABLE BASEBALL CAP

(75) Inventor: David Turner, Portland, OR (US)

(73) Assignee: Nike, Inc., Beaverton, OR (US)

( * ) Notice: Subject to any disclaimer, the term of this patent is extended or adjusted under 35 U.S.C. 154(b) by 116 days.

(21) Appl. No.: 10/820,152

(22) Filed: Apr. 8, 2004

(65) Prior Publication Data

US 2005/0223475 A1 Oct. 13, 2005

(51) Int. Cl.
*A42C 5/04* (2006.01)

(52) U.S. Cl. ..... 2/209.4; 2/410; 2/181.6; 2/195.2; 2/195.3; 2/209.12; 2/195.1; 2/195.6; 2/181; 2/181.1; 2/181.2; 2/181.4; 2/181.8; 2/182.3; 2/182.8; 442/81

(58) Field of Classification Search ..... 2/181.6, 2/195.2, 195.3, 209.4, 209.5, 209.12, 195.1, 2/195.6, 410, 181, 181.1, 181.2, 181.4, 181.8, 2/182.3, 182.8; 442/81
See application file for complete search history.

(56) References Cited

U.S. PATENT DOCUMENTS

| | | | | |
|---|---|---|---|---|
| 1,511,129 | A | | 10/1924 | McKnight |
| 1,674,361 | A | | 6/1928 | Gstalder |
| 2,052,123 | A | | 8/1936 | Adamson |
| 2,106,075 | A | | 1/1938 | Tabley |
| 2,377,933 | A | | 6/1945 | Glass |
| 2,820,226 | A | | 1/1958 | Toplei et al. |
| 3,309,713 | A | | 3/1967 | Kaufman |
| 4,491,985 | A | | 1/1985 | Dalton |
| 4,642,817 | A | | 2/1987 | Ferstenfeld |
| 4,662,007 | A | | 5/1987 | Lipkin |
| 4,815,148 | A | | 3/1989 | Satterfield |
| 4,845,762 | A | | 7/1989 | Gregg |
| 5,012,532 | A | | 5/1991 | Krystal |
| 5,025,505 | A | | 6/1991 | Fekete, Sr. |
| 5,031,246 | A | | 7/1991 | Kronenberger |
| 5,103,503 | A | | 4/1992 | Fekete, Sr. |
| 5,272,772 | A | | 12/1993 | Hahn |
| 5,384,916 | A | | 1/1995 | Portney |
| 5,402,538 | A | | 4/1995 | Conrad |
| 5,426,789 | A | | 6/1995 | MacLeod |
| 5,428,843 | A | | 7/1995 | Clowers et al. |
| 5,437,062 | A | | 8/1995 | Douglas |
| 5,481,759 | A | | 1/1996 | Rinaldi |
| 5,481,760 | A | * | 1/1996 | Wood, Jr. ..... 2/195.5 |
| 5,488,740 | A | | 2/1996 | Garza |
| 5,497,513 | A | * | 3/1996 | Arabeyre et al. ..... 2/240 |
| 5,615,415 | A | | 4/1997 | Beckerman |
| 5,632,046 | A | | 5/1997 | Green et al. |
| 5,669,076 | A | | 9/1997 | Steffy |
| 5,716,540 | A | | 2/1998 | Cho |

(Continued)

*Primary Examiner*—Gary L. Welch
*Assistant Examiner*—Alissa J Tompkins
(74) *Attorney, Agent, or Firm*—Banner & Witcoff, Ltd

(57) ABSTRACT

The invention is an article of headwear that incorporates an adjustment system for accommodating individuals with various head dimensions. The headwear may be formed of a crown and a visor. With respect to the crown, the adjustment system includes a first elastic material, which forms a majority of the crown, and a second elastic material, which is screenprinted or otherwise attached to a flap positioned within the crown. Regarding the visor, the adjustment system resides in a visor board configuration wherein slits are formed to separate various portions of the visor board. The slits permit the portions to move relative to each other, thereby permitting the visor to expand to accommodate stretching of the crown.

4 Claims, 6 Drawing Sheets

U.S. PATENT DOCUMENTS 5,724,676 A 3/1998 Amendolia et al.
5,862,522 A 1/1999 Cho
5,920,910 A * 7/1999 Calvo ..... 2/181.4
5,926,850 A 7/1999 Han
5,966,742 A 10/1999 Cunliffe
5,983,398 A 11/1999 Kronenberger
6,016,572 A 1/2000 Park
6,049,911 A 4/2000 Bromberg
6,052,825 A * 4/2000 Dodd ..... 2/68
6,052,831 A 4/2000 Park
6,067,658 A 5/2000 Cho
6,089,421 A 7/2000 Cho
6,115,844 A 9/2000 Cho
6,119,273 A * 9/2000 Cho ..... 2/195.3
6,122,774 A 9/2000 Park
6,129,250 A 10/2000 Cho
6,131,202 A * 10/2000 Yan ..... 2/195.3
6,136,280 A 10/2000 Bae
6,163,888 A 12/2000 Park
6,170,086 B1 1/2001 Lee
6,199,213 B1 3/2001 Whang
6,202,218 B1 3/2001 Cheever
6,311,331 B1 11/2001 Park
6,314,583 B1 11/2001 Cho
6,347,410 B1 2/2002 Lee
6,408,443 B1 * 6/2002 Park ..... 2/195.1
6,502,245 B1 1/2003 McBride
2003/0226193 A1 * 12/2003 Wang ..... 2/195.6

* cited by examiner

ADJUSTABLE BASEBALL CAP

BACKGROUND OF THE INVENTION

1. Field of the Invention

The present invention relates to apparel. The invention concerns, more particularly, headwear, such as a baseball cap, having a size adjustment system that accommodates individuals with various head dimensions.

2. Description of Background Art

The primary elements of a standard baseball cap include a crown and visor. The crown is conventionally configured from multiple panels, also referred to as gore sections, that are sewn together to form a generally hemispherical, close-fitting covering for a head of a wearer. The visor extends in an outward direction from a front area of the crown to provide the face and eyes with shade. A wide range of materials, natural or synthetic, may be used to form a baseball cap.

The baseball cap was originally designed to prevent sunlight and rain from obscuring the vision of a baseball player. Like other specialized athletic equipment, the original baseball cap was used exclusively in the course of competition. For aesthetic purposes, the baseball cap included indicia and a color scheme consistent with the uniform of an individual team. As the popularity of baseball grew, however, non-athletes began wearing baseball caps to publicly display their support for a particular team.

Today, baseball caps continue to be used by baseball players, whether amateur or professional, for purposes of competition, but the popularity of the baseball cap has grown beyond baseball and the notion of identifying with a particular baseball team. Modern baseball caps often display the indicia of athletic teams from sports other than baseball. In addition, baseball caps may contain the indicia of corporations, places, philosophies, or individual people such as entertainers or athletes.

Baseball caps may be classified as either fitted or adjustable. Fitted baseball caps are generally manufactured in a wide range of sizes based upon circumference of the head, with each size having fixed dimensions to accommodate an individual with corresponding head dimensions. Adjustable baseball caps, however, incorporate an adjustment system that permits a single baseball cap to accommodate individuals with various head dimensions. Accordingly, adjustable baseball caps may be manufactured with significantly fewer sizes than fitted baseball caps to accommodate size ranges rather than a particular size. Although adjustable baseball caps are generally more complex to manufacture than fitted baseball caps, the manufacturing efficiency of producing relatively few sizes reduces the overall cost of adjustable baseball caps in comparison with fitted baseball caps.

A baseball cap having a common style of adjustment system is disclosed in U.S. Pat. No. 5,272,772 to Hahn. A rear portion of the baseball cap includes a cut-out area having two overlapping straps that extend from opposite sides of the cut-out area. One of the straps includes a plurality of protrusions and the other strap includes a plurality of corresponding apertures. By varying the protrusions that are received by specific apertures, the circumference of the baseball cap is adjusted. A similar adjustment system is disclosed in U.S. Pat. No. 4,815,148 to Satterfield and incorporates portions of a hook and loop fastener that are located on opposite sides of a slit in the baseball cap.

A drawback to the baseball caps of Hahn and Satterfield relates to the aesthetic appearance of the adjustment system. The material forming the crown of fitted baseball caps extends entirely around the head. In contrast, the material forming the crown of the baseball caps of Hahn and Satterfield includes the cut-out area and slit, respectively, which breaks the continuity of the crown. Accordingly, manufacturers often incorporate an adjustment system into baseball caps that provides the appearance of a fitted baseball cap. For example, U.S. Pat. No. 6,122,774 to Park; U.S. Pat. No. 5,715,540 to Cho; and U.S. Pat. No. 5,615,415 to Beckerman each disclose adjustable baseball caps that incorporate a stretchable material. U.S. Pat. No. 5,031,246 to Kronenberger discloses an adjustable baseball cap that incorporates an inflatable bladder located within material that forms the bottom of the crown to vary the effective diameter of a headband in the crown.

SUMMARY OF THE INVENTION

The present invention is an article of headwear having a crown that includes an adjustment system for accommodating various head dimensions. The crown is primarily formed of a first elastic material and includes a flap that extends around an interior of the crown. A strip of a second elastic material is attached to the flap.

The second elastic material may be silicone that is screen-printed onto a surface of the flap. The screen printing process may form a plurality of perforations in the silicone to permit air and moisture to pass through the strip. The flap includes a first surface that faces a remainder of the crown and an opposite second surface that faces the head, with the strip being attached to the first surface. A sweatband, for example, may be attached to the second surface to contact the head. In one embodiment of the invention, the headwear is a baseball-style cap. The crown of the cap is formed of a plurality of panels, with at least one of the panels including an extension that forms a portion of the flap within the crown.

The headwear may also include a visor that expands with stretching of the crown. The visor includes a visor board having one or more slits. The slits permit the various portions of the visor board to move relative to each other, thereby permitting the visor board to expand. The visor board may be covered by elastic covering materials that stretch as the visor board expands.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
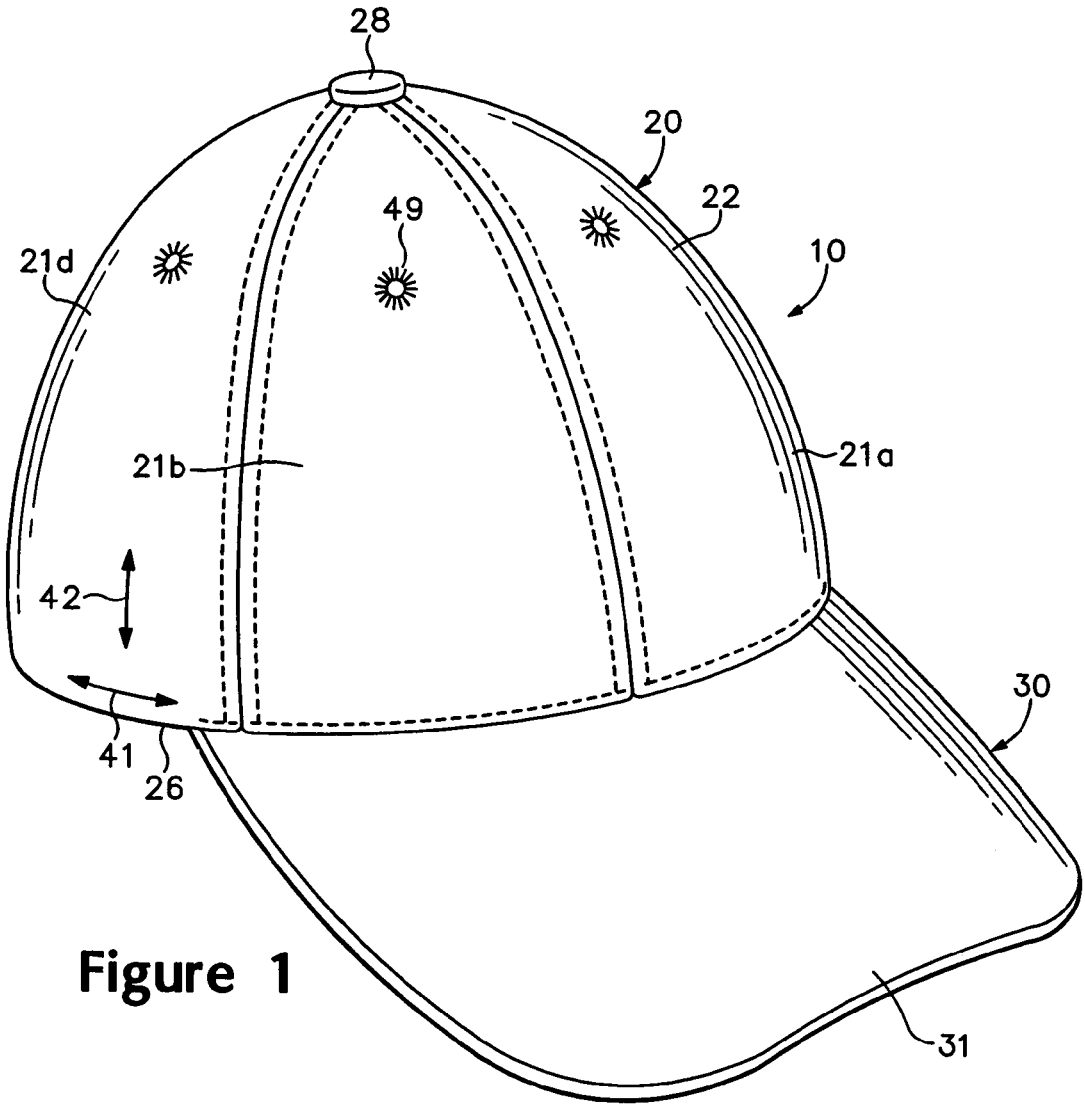
FIG. 1 is a first perspective view of an article of headwear having a crown and a visor in accordance with the present invention.

The following discussion and accompanying figures disclose an article of headwear 10 having an adjustment system in accordance with the present invention. Headwear 10 is disclosed as having the structure of a baseball cap. The concepts and features of headwear 10 that are disclosed in the following discussion may, however, be applied to a wide range of headwear types, including a bonnet, boater, beret, cowboy hat, fedora, fez, panama, sombrero, and sou'wester, for example. Accordingly, the present invention is not limited to baseball caps, but may be applied to a wide range of headwear types.

Headwear 10 is depicted in FIGS. 1-4 and includes two principal elements, a crown 20 and a visor 30. Crown 20 forms a generally hemispherical covering for a head of an individual, and visor 30 extends outward in a generally horizontal direction from crown 20 to shade the face and eyes of an individual. The materials forming crown 20 extend entirely around a circumference of the head to provide headwear 10 with the appearance of a fitted baseball cap that accommodates an individual with specific head dimensions. Headwear 10, however, incorporates an adjustment system that accommodates individuals with various head dimensions.

The adjustment system includes a first elastic material and a second elastic material that are incorporated into crown portion 20. As utilized herein, the term elastic material refers to a material property rather than a particular type of material. More specifically, the material property is the ability to substantially return to an original size and shape following a deformation. After being stretched to a reasonable degree, therefore, the first elastic material and the second elastic material are capable of substantially returning to an unstretched configuration.

Crown 20 includes a plurality of panels 21 that are attached together along abutting sides. As depicted in FIGS. 1-4, however, crown 20 includes six panels 21*a*-21*f*. More specifically, crown 20 includes two front panels 21*a* and 21*b* that are located adjacent to visor 30, two side panels 21*c* and 21*d* that are located on a left side and a right side of headwear 10, respectively, and two rear panels 21*e* and 21*f* that are located in a rear area of headwear 20. The various panels 21 define an exterior surface 22 and an opposite interior surface 23.

Panels 21 are formed of the first elastic material and will deform in the presence of a tensile force, thereby stretching to accommodate individuals with various head dimensions. The first elastic material may be any material with the ability to substantially return to an original size and shape following a deformation. Accordingly, sheets of elastomeric polymer materials are suitable. In order to enhance the air permeability and overall comfort of crown 20, however, the first elastic material may also be a textile that incorporates elastomeric fibers, such as elastane, which is manufactured under the LYCRA trademark by E.I. duPont de Nemours and Company.

Figure 2:
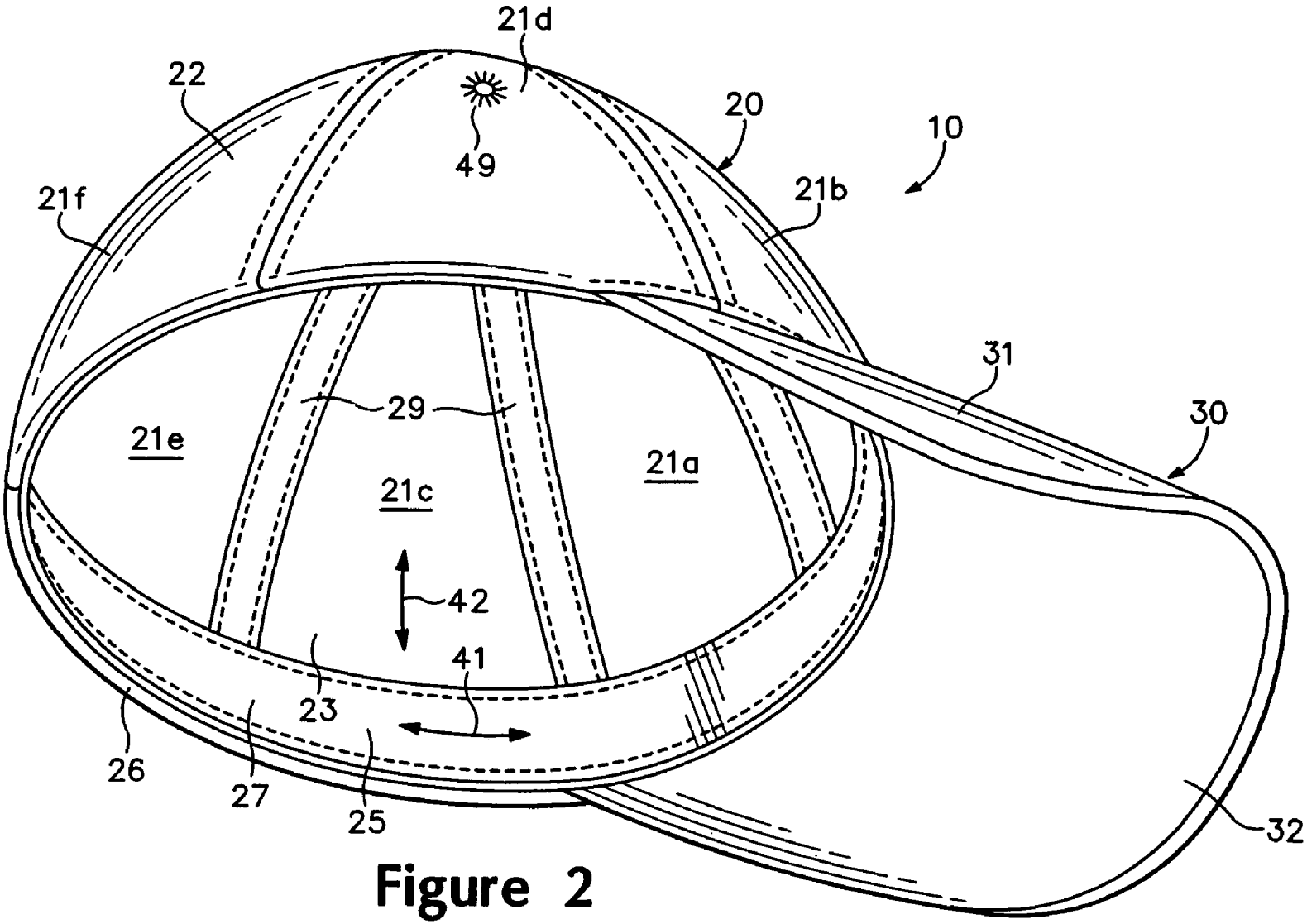
FIG. 2 is a second perspective view of the headwear that depicts an area within the crown.

Although head dimensions may vary in many respects, the circumference of the head is the specific head dimension that regularly determines whether a particular article of headwear is properly fitted. Accordingly, the circumference of crown 20 is a primary factor in determining whether headwear 10 properly fits upon a head. Referring to FIGS. 1 and 2, a first arrow 41 and a second arrow 42 are depicted for reference on crown 20. First arrow 41 extends in a horizontal direction and generally corresponds with a circumference of crown 20, whereas second arrow 42 extends in a vertical direction. By orienting the first elastic material in panels 21 such that a direction of stretch is substantially aligned with first arrow 41, crown 20 adjusts circumferentially to accommodate individuals with various head dimensions. That is, stretch of the first elastic material in a direction of first arrow 41 modifies the circumference of crown 20 to correspond with a circumference of the head.

Panels 21 may be formed from a first elastic material with one-directional stretch to provide crown 20 with stretch along first arrow 41. That is, the first elastic material may be selected to stretch in only a single direction. When manufacturing panels 21 from a material with one-directional stretch, care should be taken to ensure that the direction of stretch is properly aligned with the general direction of first arrow 41. Panels 21 may also be formed from a first elastic material with two-directional stretch, which provides crown 20 with stretch along the directions of both arrows 41 and 42. One skilled in the relevant art will recognize that materials with two-directional stretch generally appear to stretch in any direction along the plane of the material. Accordingly, the directions of stretch in a material with two-directional stretch need not be aligned with arrows 41 and 42, thereby simplifying the manufacturing process of panels 21.

The inherent tension in the crown of a fitted baseball cap ensures that the baseball cap remains securely positioned upon a head. Although the first elastic material may be selected to provide sufficient tension in headwear 10 and ensure secure positioning, a strip 24 of a second elastic material is located around at least a portion of crown 20 to provide additional tension. More specifically, strip 24 is attached to a flap 25, as depicted in FIGS. 2-5, that extends upward along interior surface 23 and from a lower edge 26 of crown 20. A sweatband 27, which may be formed of a knitted material with one or two directions of stretch, for example, forms a side of flap 25 that is opposite strip 24. The material forming sweatband 27 may also be selected to wick perspiration and other moisture away from the head.

Strip 24 is attached to flap 25 and positioned between flap 25 and interior surface 23. Although strip 24 may extend entirely around crown 20, strip 24 is depicted as extending around portions of crown 20 corresponding with panels 21*c*-21*f*. Suitable materials for the second elastic material, which forms strip 24, include any of the materials discussed above with respect to the first elastic material. Accordingly, strip 24 may be a sheet of elastomeric polymer or a textile that incorporates elastomeric fibers. Another suitable material is an elastic silicone material that is screenprinted onto flap 25.

Figure 3:
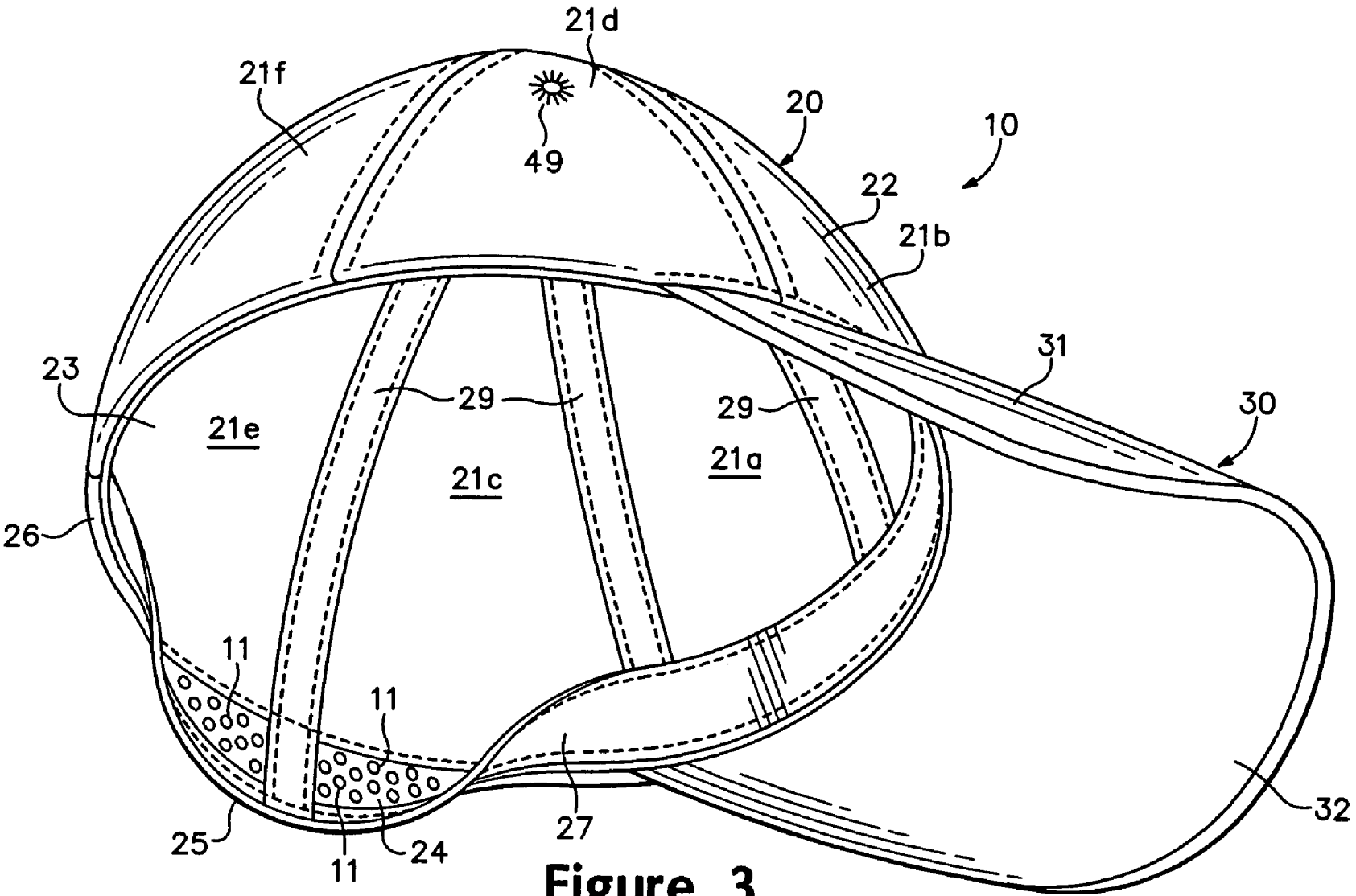
FIG. 3 is a third perspective view of the headwear that corresponds with FIG. 2 and depicts an elastic member within the crown.
Figure 4:
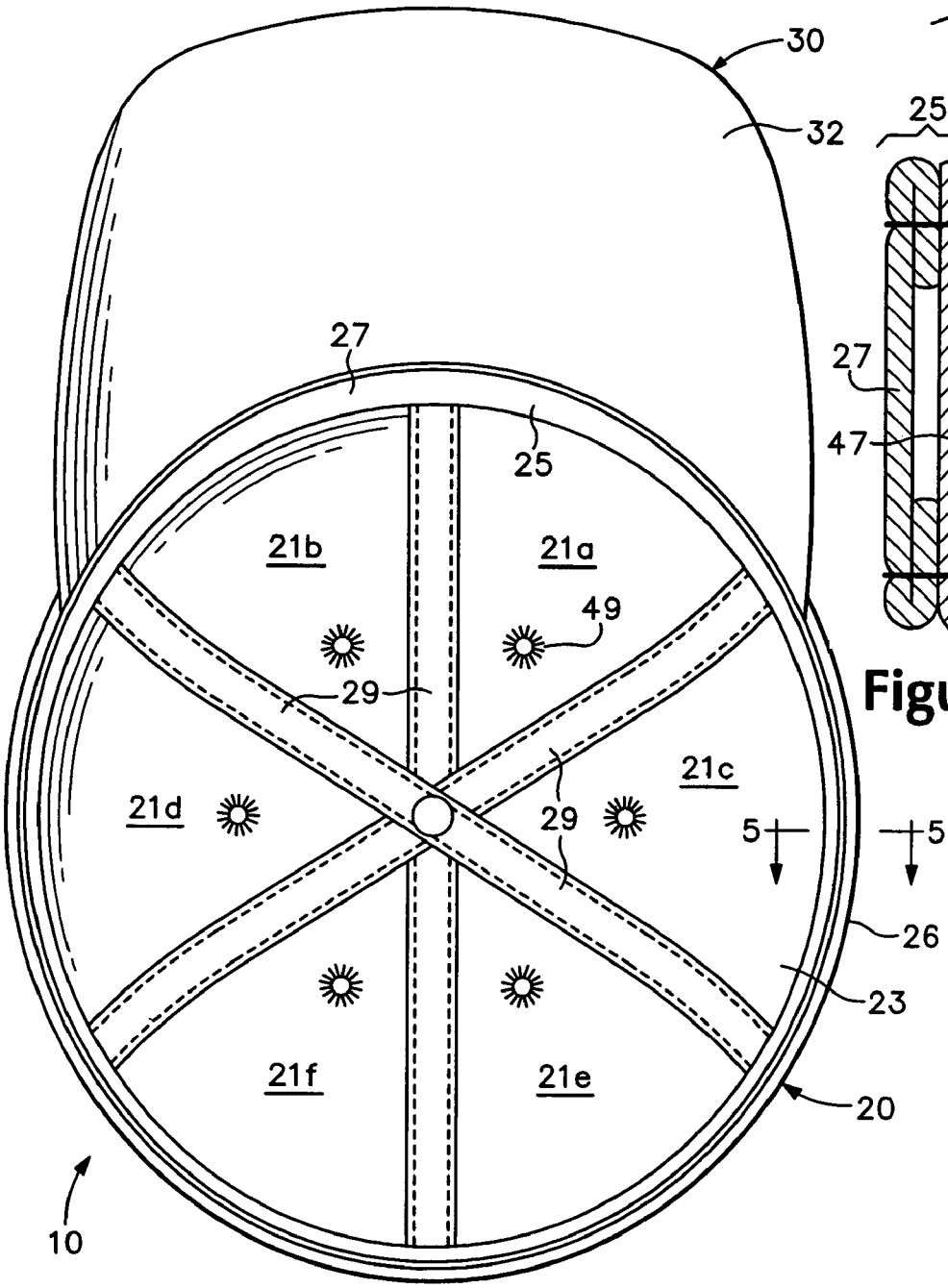
FIG. 4 is a bottom plan view of the headwear.
Figure 6A:
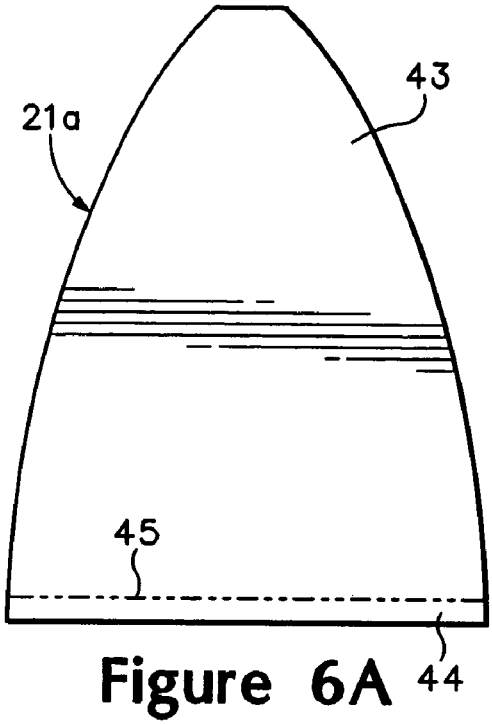
FIG. 6A is a plan view of a first panel configuration of the crown.
Figure 6B:
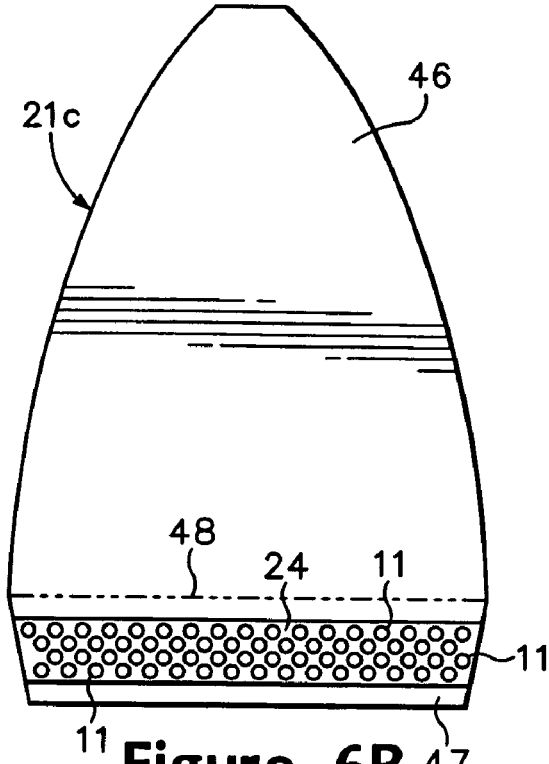
FIG. 6B is a plan view of a second panel configuration of the crown.

An advantage of the screen printing process for depositing a silicone material onto flap 25 relates to the resulting configuration of strip 24. The screen printing process provides the manufacturer with control over the thickness, width, and overall configuration of strip 24. For example, the thickness and width may be increased to provide greater tension in crown 20. Alternately, the screen printing process may be utilized to form a plurality of perforations 11 in strip 24, as depicted in FIGS. 3 and 6B. Perforations 11 may be utilized to reduce the overall tension in strip 24. Perforations 11 also provide strip 24 with air-permeability, thereby permitting moisture to escape from the area of flap 25.

As an alternative to the silicone material for strip 24, various polymer materials may be bonded or otherwise secured to flap 25. For example, the polymer materials may include polyurethane, polyamide, polyester, polyolefin, or vinyl. In addition, various polymer tapes manufactured by Bemis Associates, Inc. of Shirley, Mass., United States may be utilized. The polymer tapes are thermoplastic polymers that may be applied by commercially-available taping machines to a variety of materials, including polyester, cotton, and blended fabrics that include both polyester and cotton fibers, for example. In operation, heat and pressure is applied to induce the polymer tape to soften or melt so as to infiltrate the structure of flap 25. Upon subsequent cooling, the polymer tape becomes securely bonded to flap 25.

The structure of panels 21 will now be discussed in greater detail. Referring to FIG. 6A, front panel 21*a* is depicted as having a primary section 43 and an extension 44 that are separated by a line 45. Front panel 21*b* has a configuration that is substantially similar to front panel 21*a*. Accordingly, front panel 21*b* also includes a primary section 43 and an extension 44 that are separated by a line 45. Similarly, side panel 21*c* is depicted in FIG. 6B and includes a primary section 46 and an extension 47 that are separated by a line 48. Primary section 46 has the approximate dimensions and shape of primary section 43. Extension 47, however, has greater area than extension 44, and the sides of extension 47 taper inward to correspond with the outward taper of primary section 46 adjacent to line 48. Panels 21*d*-21*f* have a configuration that is substantially similar to side panel 21 *c*. Accordingly, panels 21*d*-21*f* also include a primary section 46 and an extension 47 that are separated by a line 48.

The elements of crown 20 discussed above may be assembled through various methods to manufacture headwear 10. One method will be discussed below to provide a greater understanding regarding the structure of headwear 10 and the adjustment system. Prior to incorporating panels 21*c*-21*f* into headwear 10, strip 24 may be screenprinted or otherwise attached to one side of extensions 47. The sides of primary sections 43 and 46 are then attached to adjacent panels 21, through stitching, for example, to generally form the hemispherical shape of crown 20. Extensions 44 provide an area for attaching both visor 20 and sweatband 27 to crown 20. In the area adjacent to visor 30, sweatband 27 thereby forms lower edge 26. A liner material, such as a textile, may also be located on interior surface 23 and adjacent to panels 21*a* and 21*b* to reinforce the front area of crown 20 and ensure an aesthetically rounded structure in the front area.

Figure 5:
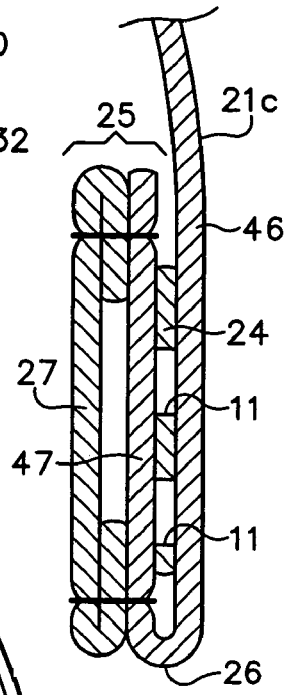
FIG. 5 is a cross-sectional view of the headwear, as defined by line 5-5 in FIG. 4.
Figure 6C:
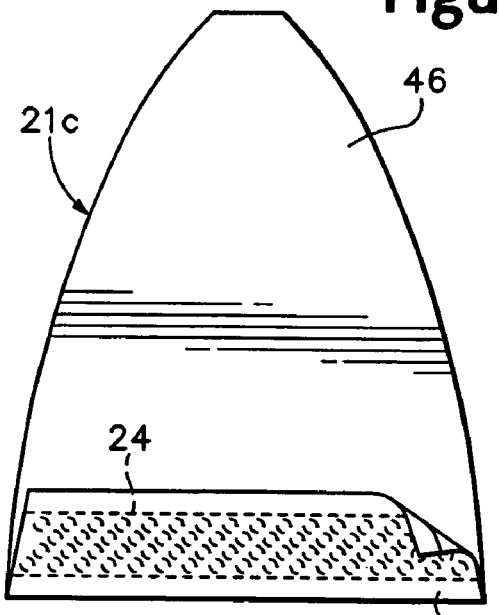
FIG. 6C is a plan view of the second panel configuration in a folded configuration.

Extensions 47 are then folded along line 48 relative to primary section 46 such that strip 24 is positioned between primary section 46 and extension 47, as depicted in FIG. 6C. That is, strip 24 is positioned adjacent to interior surface 23. In the front area of crown 20, sweatband 27 was attached to extensions 44. In the area of crown 20 corresponding with panels 21*c*-21*f*, however, sweatband 27 is attached to a side of extensions 47 that is opposite strip 24. Sweatband 27 is, therefore, located around lower edge 26 and forms an area for contacting the head of the individual. A cross-sectional view of the area around flap 25, which includes extensions 47 and sweatband 27, is depicted in FIG. 5.

At this point in the method of manufacturing headwear 10, crown 20 is generally formed to include flap 25, and visor 30 is attached to crown 20. A plurality of finishing steps may now be performed to complete the manufacture of headwear 10. For example, a button 28 may be added to a top portion of crown 20 to mask the area where panels 21 converge; seam tape 29 may be added to interior surface 23 to reinforce the seams between panels 21 and provide a quality appearance; flap 25 may be stitched to interior surface 23 along the seams between panels 21 to secure flap 25 to the interior of crown 20; and an aperture 49 may be formed in each of panels 21 to improve the transfer of air through crown 20. Although not specifically discussed, one skilled in the relevant art will recognize that the edges of various elements, including panels 21 and sweatband 27 may be turned inward prior to stitching to prevent unraveling and improve the overall aesthetics of headwear 10.

The specific structure of headwear 10, as disclosed above, may include various modifications within the scope of the present invention. For example, sweatband 27 may be formed of two separate elements. As discussed above, the portion of sweatband 27 corresponding with panels 21*c*-21*f* is attached to extensions 47, which provides support for sweatband 27. The portion of sweatband 27 corresponding with panels 21*a* and 21*b*, however, does not have a corresponding support. Accordingly, the front portion of sweatband 27 may be a separate element formed of a material having greater stiffness to provide increased support. Alternately, another element may be included with the front portions of sweatband 27 to increase support. Strip 24, as disclosed above, is screenprinted on one side of extensions 47. In alternate embodiments, strip 24 may be screenprinted on both sides of extensions 47; strip 24 may be screenprinted on primary sections 46; or strip 24 may be screenprinted on the portions of sweatband 27 corresponding with panels 21*a* and 21*b*, such that strip 24 extends entirely around the interior of crown 20.

Baseball caps conventionally include a visor with a semi-rigid polymer visor board sandwiched between textile elements. Visor 30 may incorporate a conventional visor board configuration. A limitation of the conventional visor board configuration, however, relates specifically to the adjustment system incorporated into headwear 20, as discussed above. In general, the adjustment system includes a plurality of panels 21 that are formed of the first elastic material, and a strip 24 formed of a second elastic material. Ideally, therefore, each of panels 21 would be free to deform, thereby modifying the dimensions of headwear 10 to accommodate individuals with various head dimensions. The conventional visor board, however, would limit the degree of deformation in panels 21*a* and 21*b*. Accordingly, visor 30 may be formed to have an alternate configuration that permits panels 21*a* and 21*b* to deform.

Figure 7A:
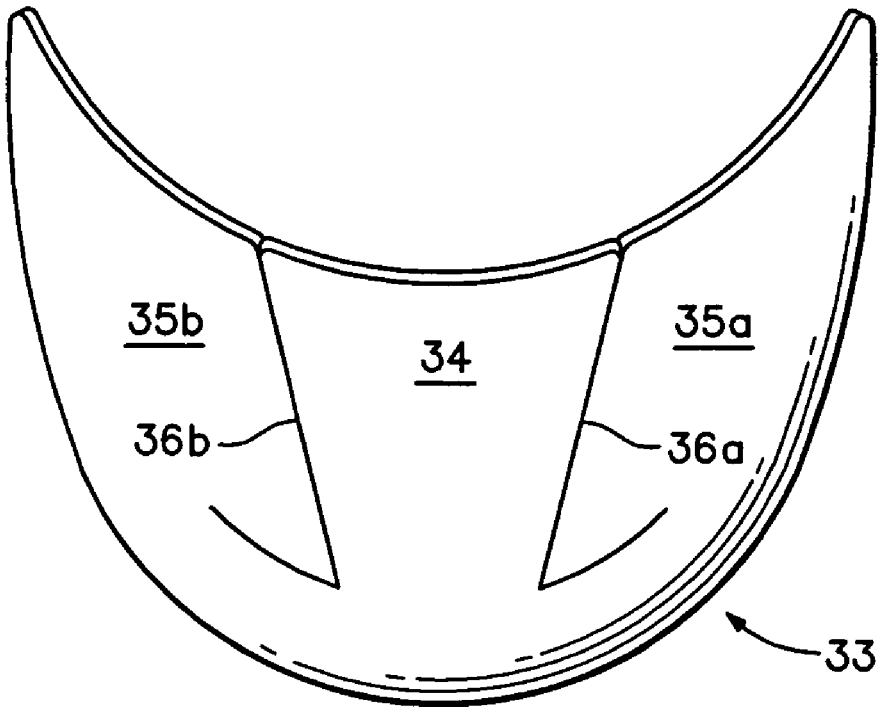
FIG. 7A is a perspective view of a visor board.

Visor 30 includes a pair of outer coverings 31 and 32 that encompass a visor board 33, which is depicted in FIG. 7A. Outer coverings 31 and 32 are formed of a material having at least one-directional stretch, and may be the same material as panels 21. Visor board 33 includes a central section 34 and two end sections 35*a* and 35*b*. A pair of generally L-shaped slits 36*a* and 36*b* in visor board 30 separates end sections 35*a* and 35*b* from central section 34. Slits 36*a* and 36*b* permit end sections 35*a* and 35*b* to move relative to central section 34. More specifically, slits 36*a* and 36*b* permit end sections 35*a* and 35*b* to have greater freedom of movement than corresponding portions of a conventional visor board.

Figure 7B:
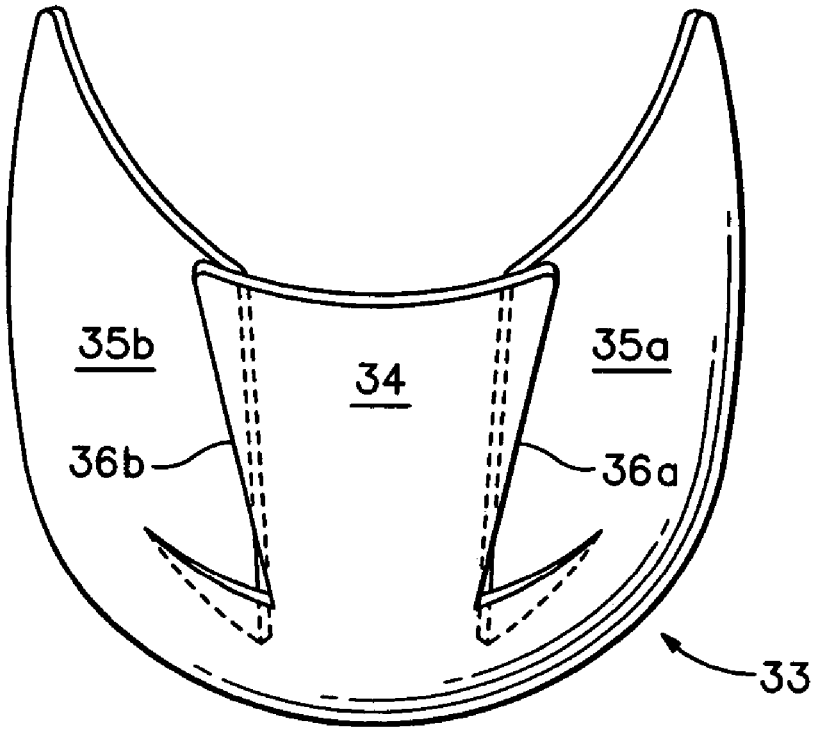
FIG. 7B is a perspective view of the visor board wherein end sections extend under a central section.

Visor 30 is assembled such that coverings 31 and 32 extend around visor board 33. Coverings 31 and 32 may place a small degree of pressure upon visor board 33 such that end sections 35*a* and 35*b* extend partially under central section 34, as depicted in FIG. 7B. When headwear 10 is in an unstretched configuration, therefore, end sections 35*a* and 35*b* partially overlap central section 34. As panels 21 are stretched, however, coverings 31 and 32 are stretched a corresponding amount and visor board 33 expands to accommodate the stretch in coverings 31 and 32. That is, end sections 35*a* and 35*b* slide relative to central section 34 to expand visor board 33. Accordingly, visor board 33 may have a configuration that complements the adjustment system of headwear 10 and permits front panels 21*a* and 21*b* to stretch.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of headwear having an adjustment system for accommodating various head dimensions, the headwear comprising a crown for covering at least a portion of a head, the crown being at least partially formed of a first elastic material, and the crown including a strip of a second elastic material, wherein the second elastic material is silicone, the strip being secured onto a surface of the crown, and the strip defining a plurality of apertures extending through the strip to expose portions of the first elastic material.

2. A cap having an adjustment system for accommodating various head dimensions, the cap comprising:

a crown for covering at least a portion of a head, the crown being at least partially formed of a first elastic material, and the crown including a flap positioned adjacent an interior surface of the crown, and the crown including a strip of a second elastic material that is bonded onto the flap, wherein the second elastic material is silicone, and the strip defining a plurality of apertures extending through the strip to expose portions of the first elastic material; and a visor attached to the crown.

3. A cap having an adjustment system for accommodating various head dimensions, the cap comprising:

a crown for covering at least a portion of a head, the crown being at least partially formed of an elastic textile, and the crown including a flap positioned adjacent an interior surface of the crown, the flap defining a first surface and an opposite second surface, the first surface being oriented to face away from the head and the second surface being oriented to face the head, and the crown including a strip of elastic silicone that is bonded onto the first surface, wherein the elastic textile and the elastic silicone stretch in a direction of a circumference of the crown, the strip including a plurality of perforations that form apertures extending entirely through the strip, the perforations being aligned to form parallel rows of the perforations; and a visor attached to the crown, the visor having a configuration that expands in response to a stretching of the crown.

4. A cap having an adjustment system for accommodating various head dimensions, the cap comprising:

a crown including a plurality of panels formed from a first elastic material, the panels being attached together to form a generally hemispherical structure for extending over a head, at least one of the panels having:

a primary section forming at least a portion of an exterior of the crown, and an extension that is attached to an edge of the primary section, the extension being folded relative to the primary section and located adjacent to the primary section, the extension having a first surface oriented to face the primary section and an opposite second surface oriented to face the head, and the crown including a strip of a second elastic material that is attached to the first surface, wherein the second elastic material is silicone that is secured to the first surface, and the crown including a sweatband attached to the second surface; and a visor attached to the crown, the visor having a configuration that expands in response to a stretching of the crown.

* * * * *